US009491971B2

(12) United States Patent
Xue et al.

(10) Patent No.: US 9,491,971 B2
(45) Date of Patent: Nov. 15, 2016

(54) SPECIFICALLY-DEFINED SMOKING ARTICLE WITH ACTIVATED CARBON SORBENT AND SODIUM BICARBONATE-TREATED FIBERS AND METHOD OF TREATING MAINSTREAM SMOKE

(75) Inventors: Lixin Xue, Midlothian, VA (US); Liqun Yu, Midlothian, VA (US); Joel Schendel, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1943 days.

(21) Appl. No.: 11/636,588

(22) Filed: Dec. 11, 2006

(65) Prior Publication Data

US 2007/0181141 A1 Aug. 9, 2007

Related U.S. Application Data

(60) Provisional application No. 60/749,595, filed on Dec. 13, 2005.

(51) Int. Cl.

| | |
|---|---|
| ***A24D 3/06*** | (2006.01) |
| ***A24D 3/16*** | (2006.01) |
| *A24D 1/00* | (2006.01) |
| *A24D 3/00* | (2006.01) |
| *A24D 3/04* | (2006.01) |

(52) U.S. Cl.

CPC ..... *A24D 3/163* (2013.01); *A24D 3/16* (2013.01); *A24D 1/00* (2013.01); *A24D 1/002* (2013.01); *A24D 1/008* (2013.01); *A24D 3/00* (2013.01); *A24D 3/04* (2013.01); *A24D 3/048* (2013.01)

(58) Field of Classification Search

CPC ..... A24D 3/16; A24D 3/163; A24D 1/002; A24D 1/008; A24D 1/00; A24D 3/00; A24D 3/04; A24D 3/048

USPC ..... 131/344

See application file for complete search history.

(56) References Cited

U.S. PATENT DOCUMENTS

| | | | |
|---|---|---|---|
| 3,332,428 | A | 7/1967 | Mold et al. |
| 3,353,544 | A | 11/1967 | Fordyce |

(Continued)

FOREIGN PATENT DOCUMENTS

| | | | |
|---|---|---|---|
| BE | 679 236 | A | 9/1966 |
| EP | 1 541 044 | A1 | 6/2005 |

(Continued)

OTHER PUBLICATIONS

International Preliminary Report on Patentability for PCT/IB2006/004086 dated Jun. 18, 2008.

(Continued)

*Primary Examiner* — Philip Tucker
*Assistant Examiner* — Vicki Wu
(74) *Attorney, Agent, or Firm* — Buchanan Ingersoll & Rooney PC

(57) ABSTRACT

Filters and smoking articles include sodium bicarbonate-treated fibers and activated carbon capable of selectively removing one or more selected constituents from mainstream smoke. Methods for making cigarette filters and cigarettes using the sodium bicarbonate-treated fibers and activated carbon, and methods for treating mainstream smoke comprising the sodium bicarbonate-treated fibers and activated carbon are also provided.

28 Claims, 1 Drawing Sheet

(56) References Cited

U.S. PATENT DOCUMENTS

| | | | | | |
|---|---|---|---|---|---|
| 3,368,566 | A | | 2/1968 | Avedikian | |
| 3,370,592 | A | | 2/1968 | Schultz et al. | |
| 3,403,689 | A | | 10/1968 | Sublett et al. | |
| 3,405,717 | A | | 10/1968 | Berger et al. | |
| 3,407,820 | A | | 10/1968 | Wetcott et al. | |
| 3,419,543 | A | | 12/1968 | Mold et al. | |
| 3,426,763 | A | | 2/1969 | Sloan et al. | |
| 3,428,055 | A | | 2/1969 | Sublett et al. | |
| 3,428,056 | A | | 2/1969 | Sublett et al. | |
| 3,434,479 | A | | 3/1969 | Till et al. | |
| 3,470,883 | A | * | 10/1969 | Shepherd et al. | 131/332 |
| 3,605,759 | A | * | 9/1971 | Owens, Jr. et al. | 131/341 |
| 3,664,352 | A | | 5/1972 | Norman et al. | |
| 4,763,674 | A | | 8/1988 | Lelah | |
| 4,896,683 | A | | 1/1990 | Cohen et al. | |
| 4,964,426 | A | | 10/1990 | Lee et al. | |
| 4,966,171 | A | | 10/1990 | Serrano et al. | |
| 5,009,239 | A | | 4/1991 | Cohen et al. | |
| 5,150,723 | A | | 9/1992 | Lee et al. | |
| 5,322,075 | A | | 6/1994 | Deevi et al. | |
| 5,499,636 | A | | 3/1996 | Baggett, Jr. et al. | |
| 5,591,368 | A | | 1/1997 | Fleischhauer et al. | |
| 5,666,976 | A | | 9/1997 | Adams et al. | |
| 5,690,126 | A | * | 11/1997 | Matsumura | A24D 3/10 131/331 |
| 5,692,525 | A | | 12/1997 | Counts et al. | |
| 5,692,526 | A | | 12/1997 | Adams et al. | |
| 5,915,387 | A | | 6/1999 | Baggett, Jr. et al. | |
| 5,934,289 | A | | 8/1999 | Watkins et al. | |
| 5,988,176 | A | | 11/1999 | Baggett, Jr. et al. | |
| 6,026,820 | A | | 2/2000 | Baggett, Jr. et al. | |
| 6,030,698 | A | | 2/2000 | Burchell et al. | |
| 6,053,176 | A | | 4/2000 | Adams et al. | |
| 6,631,722 | B2 | * | 10/2003 | MacAdam et al. | 131/331 |
| 2003/0154993 | A1 | * | 8/2003 | Paine et al. | 131/341 |
| 2003/0200973 | A1 | * | 10/2003 | Xue et al. | 131/202 |
| 2004/0129280 | A1 | * | 7/2004 | Woodson et al. | 131/194 |
| 2004/0211728 | A1 | | 10/2004 | Liu et al. | |

FOREIGN PATENT DOCUMENTS

| | | | | |
|---|---|---|---|---|
| EP | 1541044 | A1 | * | 6/2005 |
| ES | 2131019 | | | 7/1999 |
| FR | 1 034 940 | A | | 12/1970 |
| FR | A-203940 | | | 12/1970 |
| GB | 896599 | | | 5/1962 |
| GB | A-1085582 | | | 10/1967 |
| GB | 1116644 | | | 6/1968 |
| JP | 63-152968 | | | 5/1988 |
| JP | 11-243939 | | | 9/1999 |
| WO | WO 2004026054 | A1 | * | 4/2004 |

OTHER PUBLICATIONS

Pure Appl. Chem., vol. 73, No. 2, pp. 381-394 (2001).

Bednarcyk, N. E., Tobacco Smoke Filters, Park Ridge, NJ: Noyes Data, p. 145 (1972).

Official Action issued Apr. 4, 2012 (partial translation attached) for Japanese Patent Appln. No. 2008-545145.

International Search Report and Written Opinion dated Aug. 16, 2007 for PCT/IB2006/004086.

* cited by examiner

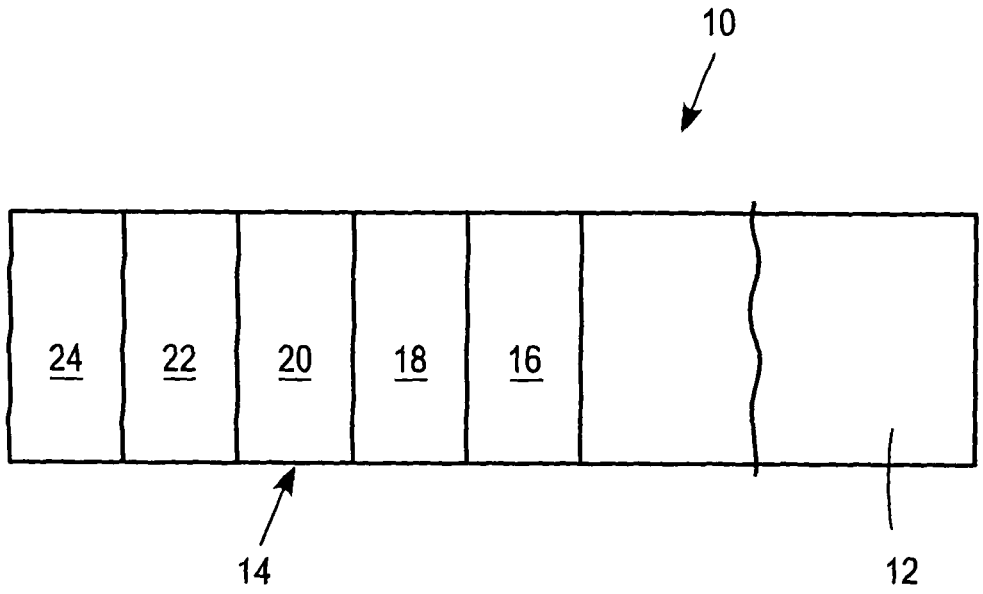
10
24
22
20
18
16
14
12

SPECIFICALLY-DEFINED SMOKING ARTICLE WITH ACTIVATED CARBON SORBENT AND SODIUM BICARBONATE-TREATED FIBERS AND METHOD OF TREATING MAINSTREAM SMOKE

CROSS REFERENCE TO RELATED APPLICATION

This application claims priority under 35 U.S. C. §119(e) to U.S. Provisional Application No. 60/749,595, filed on Dec. 13, 2005, the entire content of which is incorporated herein by reference.

BACKGROUND

A variety of filter materials have been suggested for incorporation into cigarette filters for treating tobacco smoke. Such materials include, e.g., cellulose acetate cotton, paper and synthetic fibers. Different forms of carbon have also been described.

SUMMARY

Filters, smoking articles and methods for removing selected constituents from mainstream smoke using activated carbon and sodium bicarbonate are provided. A preferred embodiment of the filters comprises activated carbon and sodium bicarbonate-treated fibers, which can selectively remove constituents from mainstream smoke. The activated carbon is provided upstream in the filter from the sodium bicarbonate-treated fibers.

In another embodiment, a flavoring section is provided downstream of the sodium bicarbonate-treated fibers and/or between the activated carbon and the sodium bicarbonate-treated fibers.

In another preferred embodiment, a smoking article comprises activated carbon and sodium bicarbonate-treated fibers. An optional flavoring section can be provided along the filter of the smoking article. The smoking article is preferably a traditional lit-end cigarette or a non-traditional cigarette.

A preferred embodiment of a method of making a cigarette filter comprises incorporating activated carbon, sodium bicarbonate-treated fibers and a flavoring section into a filter.

A preferred embodiment of a method of making a cigarette comprises placing a paper wrapper around a tobacco column, and attaching a cigarette filter to the tobacco column to form the cigarette, wherein the cigarette filter includes activated carbon, sodium bicarbonate-treated fibers and a flavoring section.

A preferred embodiment of methods of treating mainstream smoke comprises heating or lighting tobacco in a cigarette to form smoke, and drawing the smoke through the cigarette. Activated carbon and sodium bicarbonate-treated fibers in the cigarette remove selected constituents from the mainstream smoke. Optionally, after the smoke passes through the sodium bicarbonate-treated fibers, flavoring is added to the smoke in a flavoring section of the cigarette.

BRIEF DESCRIPTION OF THE DRAWING FIGURES

FIG. 1 illustrates a preferred embodiment of a cigarette comprising a filter element including sodium bicarbonate-treated fibers, activated carbon and an optional flavoring section.

DETAILED DESCRIPTION OF PREFERRED EMBODIMENTS

Cigarette filters and cigarettes are described that include sorbent materials capable of removing selected constituents from mainstream smoke. Methods of making the filters and cigarettes, as well as methods of treating mainstream smoke in cigarettes that include the filters, are also described.

In a preferred embodiment, the sorbent material comprises activated carbon and sodium bicarbonate-treated fibers. The activated carbon is disposed in the cigarette filter upstream from the sodium bicarbonate-treated fibers, i.e., closer to the mouth end of the cigarette filter than the activated carbon. Activated carbon can remove certain constituents from mainstream smoke. It has been determined, however, that activated carbon can produce a less than totally satisfactory smoke subjective character. This effect on the smoke subjective character can result from activated carbon removing certain mainstream smoke constituents and consequently changing the balance of the constituents in the mainstream smoke that affect smoke subjective character.

It has further been determined that sodium bicarbonate-treated fibers (i.e., $NaHCO_3$-treated fibers) can selectively remove selected constituents from mainstream cigarette smoke that are partially removed by activated carbon. Moreover, smoke may develop an activated carbon taste from passing through the activated carbon.

The cigarette filter can optionally contain a flavoring section. Mainstream smoke picks up flavoring in the flavoring section, thereby affecting the subjective (organoleptic) character of the smoke.

As used herein, the term "sorption" includes filtration by adsorption and/or adsorption. Sorption encompasses interactions on the outer surface of the sorbent, as well as interactions within the pores and channels of the sorbent. In other words, a "sorbent" is a substance that can condense or hold molecules of other substances on its surface, and/or can take up other substances, i.e., through penetration of the other substances into its inner structure, or into its pores. Accordingly, the term "sorbent" as used herein refers to either an adsorbent, an absorbent, or a substance that can function as both an adsorbent and an absorbent.

As used herein, the term "remove" refers to adsorption and/or absorption of at least some portion of at least one constituent of mainstream smoke.

The term "mainstream" tobacco smoke includes the mixture of gases, solid particulate and aerosol that passes down the tobacco column and is drawn through the filter end of a cigarette during a puff.

Depending on its pore structure, activated carbon can be characterized as being microporous, mesoporous and/or macroporous. The term "microporous" generally refers to such materials with pore sizes of about 2 nanometer (nm) or less. The term "mesoporous" generally refers to such materials with pore sizes of about 2-50 nm. Materials with pore sizes of about 500 angstrom (Å) or larger may be referred to as "macroporous." See, for example, *Pure Appl. Chem.*, Vol. 73, No. 2, pp. 381-394 (2001). Microporous, mesoporous and/or macroporous activated carbon can be chosen based on the selected constituents that are desired to be removed from mainstream smoke.

FIG. 1 illustrates a preferred embodiment of a cigarette 10 comprising a tobacco column 12 and a filter 14 attached to the tobacco column by tipping paper. The filter 14 includes a first plug 16, activated carbon 18, and sodium bicarbonate-treated fibers 20 downstream from the activated carbon 18. In the embodiment, the filter 14 also includes a flavoring section 22 downstream from the sodium bicarbonate-treated fibers, and a mouth end plug 24.

The embodiment of the cigarette depicted in FIG. 1 is a traditional cigarette. However, activated carbon, sodium-bicarbonate-treated fibers and flavoring section can also be incorporated in non-traditional cigarettes. Non-traditional cigarettes include, for example, smoking articles that include combustible heat sources, such as the smoking articles described in commonly-assigned U.S. Pat. No. 4,966,171, and cigarettes of electrical smoking systems as described in commonly-assigned U.S. Pat. Nos. 6,026,820; 5,988,176; 5,915,387; 5,692,526; 5,692,525; 5,666,976 and 5,499,636, each of which is incorporated herein by reference in its entirety.

The activated carbon can be in any suitable form in the filter. For example, the activated carbon can be fibers, beads, granules, one or more monolithic bodies and/or provided as a coating on a substrate. The amount of beaded activated carbon in the cigarette is preferably from about 50 mg to about 250 mg.

In a preferred embodiment, the activated carbon is in the form of spherical beads to achieve a desired resistance-to-draw (RTD). The beads can typically have an average diameter of from about 0.2 mm to about 1 mm, with 0.3 mm to 0.5 mm beads being preferred to achieve a desired RTD.

In another preferred embodiment, monolithic bodies of activated carbon can have a cylindrical shape, as well as various other shapes that may include oval or polygonal cross sectional shapes, sheet-like, spherical, honeycomb, or other monolithic shapes, and the like. The monolithic bodies can have different sizes. For example, when used in monolithic form in a cigarette filter, the activated carbon can be disc-shaped or cylindrical, and preferably has a length of from about 2 mm to about 20 mm and a diameter slightly less than the diameter the filter portion of the cigarette. The monolithic body preferably has a pore size distribution and size, e.g., a length or thickness, to provide a suitably low RTD value during smoking of a cigarette.

In a preferred embodiment, the monolithic body is oriented in a cigarette filter so that the body extends lengthwise along the length dimension of the cigarette. Such orientation of the activated carbon increases the length of the flow path through the activated carbon traveled by mainstream smoke, thus exposing the smoke to an increased total surface area of pores of activated carbon. For a disc-shaped monolithic body, the inlet and outlet of the disc (i.e., the opposed major surfaces) are preferably oriented perpendicular to the longitudinal axis of the cigarette.

In a preferred embodiment, the carbon is in the form of fibers having a diameter of from about 10 microns to about 25 microns, and a length of from about 100 microns to about 1000 microns, preferably from about 100 microns to about 500 microns. The fibers can be intermingled with fiber tow material, incorporated in paper, or form a plug.

In a preferred embodiment, the activated carbon can be incorporated in the filter portion of a cigarette in various ways, including, for example, with various materials, such as paper, fibers and other materials, and/or the activated carbon can be incorporated in a space, and/or void (cavity). For example, carbon-containing paper can be inserted into a hollow portion of the cigarette filter. The paper is preferably in the form of a sheet material, such as crepe paper, filter paper or tipping paper. However, other suitable materials, such as organic or inorganic cigarette compatible materials, can also be used.

The activated carbon can be produced by processing a suitable carbonaceous material or carbon-yielding precursor. For example, the activated carbon can be produced from carbon beads, or from natural or synthetic organic materials. In another preferred embodiment, the activated carbon can be produced using isotropic fibers derived from a suitable isotropic pitch precursor. The manufacture of such carbon fibers is described, for example, in U.S. Pat. No. 6,030,698, which is incorporated herein by reference in its entirety. Other types of carbon fibers, such as fibers derived from coal tar pitch, rayon, or heavy oils also can be used. Suitable carbon fibers are commercially available from Ashland Petroleum Company, located in Ashland, Ky., and from Anshan East Asia Carbon Company, located in Anshan, China.

Carbonaceous materials are subjected to an activation process to produce activated carbon having a desired pore structure. Porous carbon materials are subjected to activation to modify their existing pore structure by forming additional pores and changing the existing pore size distribution.

The activation step utilizes any suitable oxygen-containing environment, for example, steam, carbon dioxide, oxygen or potassium hydroxide solution, at an elevated temperature, e.g., from about 400° C. to about 900° C. The environment can also contain other gases, such as nitrogen. These gases react with the carbon to produce a desired porous carbon structure. Oxygen and nitrogen can also be chemically attached to the carbon surface to enhance gas filtration selectivity based on chemisorption, i.e., the formation of a covalent bond.

In a preferred embodiment, the carbonaceous material is activated to a desired level of burn-off. The "burn-off" represents the weight loss (i.e., weight loss=initial weight−final weight) of the carbon that occurs during the activation process. During activation, burn-off is preferably controlled to control the pore size and pore surface area of the activated carbon. The BET (Brunauer, Emmett and Teller) surface area of the activated carbon is preferably from about 1000 $m^2/g$ to about 3,000 $m^2/g$.

Sodium bicarbonate-treated fibers are provided in the cigarette filter to remove selected constituents that remain in mainstream smoke after the smoke has passed through the activated carbon. For example, it has been determined that sulfur compounds and acidic compounds that may be present in mainstream smoke may not be effectively removed by activated carbon and consequently remain in mainstream smoke after passing through the activated carbon. It has further been determined that sodium bicarbonate-treated fibers can remove such constituents from the mainstream smoke, especially when the fibers are placed downstream of the activated carbon in a cigarette filter.

By providing the sodium bicarbonate on fibers, the surface area of the sodium bicarbonate to which mainstream smoke is exposed in the cigarette can be enhanced. The fibers on which sodium bicarbonate is provided can be of any suitable material. For example, the fibers can be of materials including, but not limited to, cellulose tow, cellulose acetate tow, mono cellulose, mono acetate, propylene, polyester, polysulfone or polypropylene (e.g., Triad® polypropylene micro-cavity fibers available from Honeywell International Inc. located in Morristown, N.J.). The polymeric fibers preferably contain micro-cavities.

The fibers can be provided in the filter in any suitable form. For example, the fibers can be in the form of a continuous bundle, a mat, or the fibers can be cut into desired lengths, e.g., from about 0.5 mm to about 5 mm. The fibers preferably have a diameter of from about 1 micron to about 100 microns, more preferably from about 30 microns to about 60 microns.

The amount of sodium bicarbonate on the treated fibers in the filter is preferably sufficient to effectively counteract, at least in part, the perceived taste deficit associated with an activated carbon by American smokers. In addition, the amount of the sodium bicarbonate provided on the treated fibers is preferably sufficient to be capable of removing a desired amount of selected constituents, e.g., sulfur compounds (e.g., hydrogen sulfide and/or carbonyl sulfide) and acidic compounds. Preferably, the amount of sodium bicarbonate provided on the fibers is from about 5 mg to about 100 mg per cigarette filter, more preferably 5 mg to 30 mg and even more preferably 5 mg to 15 mg. Not wishing to be bound by theory, it is believed that activated carbon in a cigarette filter has lower selectivity (lower affinity) for sulfur containing constituents of mainstream smoke, with a result that activated carbon causes the relative amount (proportion) of sulfur compounds in the filtered smoke to be altered (increased), and that change in constituency contributes to the perceived taste deficit associated with an activated carbon by American smokers. Thus, by placing sodium bicarbonate downstream of the activated carbon in the filter, it is believed that the relative amount of sulfur compounds in the tobacco smoke can be reduced and thus render the smoke more acceptable to the smoker.

In a preferred embodiment, the cigarette filter optionally contains a flavoring (flavor release) section. The smoke picks up flavoring in the flavoring section, thereby affecting the subjective (organoleptic) character of the smoke. In a preferred embodiment, the flavoring section is located downstream of the sodium bicarbonate-treated fibers. In this embodiment, the flavoring is released during passage of the mainstream smoke through the flavoring section, thereby affecting the subjective character of the mainstream smoke.

In other preferred embodiments, flavoring can be provided at one or more different locations of the filter and/or the tobacco column. For example, the flavoring section can be located between the activated carbon and sodium bicarbonate-treated fibers, and/or in the tobacco column.

The optional flavoring provided in the cigarette filter is preferably at least one of menthol and mint. The amount of flavoring is preferably sufficient to provide a desired amount of flavoring into mainstream smoke that passes through the flavoring section during smoking of a cigarette, so as to provide the desired flavor to the smoke. For example, in a preferred embodiment, the flavoring section can contain from about 5 mg to about 50 mg of flavoring, such as menthol.

In a preferred embodiment, the flavoring is incorporated in the flavoring section in a form that preferably minimizes release and migration of the flavoring in the cigarette prior to smoking, e.g., at ambient conditions, and preferably minimizes deactivation of the activated carbon and sodium bicarbonate-treated fibers by the flavoring. Consequently, the flavoring preferably enhances subjective characteristics of the cigarette while not negatively affecting the ability of the sorbent material to remove gas-phase constituents from mainstream smoke. For example, the flavoring can be encapsulated and provided in the form of a flavoring-release additive, as described in commonly-assigned U.S. Application No. 2004/0129280, filed on Oct. 30, 2003, which is incorporated herein by reference in its entirety. The flavoring-release additives can be in the form of beads, films and inclusion complexes, and the flavoring-release additives can be released at different minimum temperatures. Accordingly, in a preferred embodiment, one or more flavoring-release additives are located at one or more locations in the cigarette at which at least the minimum temperate for release of the flavoring is achieved during smoking.

An exemplary embodiment of a method of making a filter comprises incorporating activated carbon and sodium bicarbonate-treated fibers into a cigarette filter and/or a tobacco column. In a preferred embodiment, flavoring is also incorporated into the filter. Any conventional or modified method of making cigarette filters may be used to incorporate the activated carbon, sodium bicarbonate-treated fibers and flavoring in cigarettes.

Embodiments of methods for making cigarettes comprise placing tipping paper around a tobacco rod, and attaching a cigarette filter to the tobacco column to form the cigarette. The cigarette filter contains activated carbon and sodium bicarbonate-treated fibers. In a preferred embodiment, the filter also contains flavoring.

Examples of suitable types of tobacco materials that may be used include flue-cured, Burley, Md. or Oriental tobaccos, rare or specialty tobaccos and blends thereof. The tobacco material can be provided in the form of tobacco lamina; processed tobacco materials, such as volume expanded or puffed tobacco, processed tobacco stems, such as cut-rolled or cut-puffed stems, reconstituted tobacco materials, or blends thereof. Tobacco substitutes may also be used.

In cigarette manufacture, the tobacco is normally in the form of cut filler, i.e., in the form of shreds or strands cut into widths ranging from about 1/10 inch to about 1/20 inch, or even 1/40 inch. The lengths of the strands range from between about 0.25 inches to about 3.0 inches. The cigarettes may further comprise one or more flavorants or other additives (e.g., burn additives, combustion modifying agents, coloring agents, binders and the like).

The resulting cigarettes can be manufactured to any desired specification using standard or modified cigarette making techniques and equipment. The cigarettes may range from about 50 mm to about 120 mm in length.

Other preferred embodiments relate to methods of treating mainstream smoke in a cigarette described above, which involve selectively removing sulfur-containing compounds and/or acidic compounds from the mainstream smoke by contacting the mainstream smoke with bicarbonate treated fibers. The cigarette can contain flavoring, which is released into the mainstream smoke.

"Smoking" of a cigarette means the heating or combustion of the cigarette to form tobacco smoke. Generally, smoking of a cigarette involves lighting one end of the cigarette and drawing the cigarette smoke through the mouth end of the cigarette, while the tobacco contained in the tobacco column undergoes a combustion reaction. However, the cigarette may also be smoked by heating the cigarette using an electrical heater, as described, for example, in any one of commonly-assigned U.S. Pat. Nos. 6,053,176; 5,934,289; 5,591,368 and 5,322,075, each of which is incorporated herein by reference in its entirety.

EXAMPLE

Tests were conducted to demonstrate the effectiveness of a modified cigarette containing activated carbon and sodium bicarbonate-treated fibers for removing certain gas-phase constituents from mainstream smoke. Reference cigarettes were made by incorporating 180 mg of activated carbon derived from coconut shells into a cigarette.

Model 1 cigarettes were made by dissolving sodium bicarbonate solid into a 20% aqueous solution and then applying the solution onto cellulose acetate tow fibers in plugs located adjacent the mouth end plug of the filter. The plugs had a length of 9 mm. Excess liquid was removed from the plugs and the plugs were allowed to dry at room temperature for 24 hours in a convective oven. The plugs increased in weight by about 33 mg to 37 mg. The treated plugs were reinserted in the same cigarettes.

Model 2 cigarettes were made by incorporating 50 mg of sodium bicarbonate powder downstream from 180 mg of activated carbon in the filter.

1R4F cigarettes, the reference cigarettes and the Model 1 and 2 cigarettes were tested under standard FTC conditions. No significant change was observed for the RTD and dilution ratio for the Model 1 and 2 cigarettes. Table 1 shows the test results for the fourth puff for certain smoke constituents. The average delivery values for the reference cigarettes are the percentage of the 1 R4F cigarette total delivery. For example, the reference cigarettes provided 42.6% of the 1,2-propadiene delivery of the 1R4F cigarettes. As shown in Table 1, the Model 2 cigarettes containing sodium bicarbonate powder did not yield any significant change for the selected constituents with respect to the reference cigarettes. In contrast, the composition of the smoke for the Model 1 cigarettes containing sodium bicarbonate-treated fibers was significantly modified relative to the reference cigarettes. Particularly, the Model 1 cigarettes significantly reduced various smoke constituents, especially sulfur-containing compounds, such as hydrogen sulfide and carbonyl sulfide. As a result of effectively removing such sulfur-containing compounds from the smoke, the smoke subjective character may have been improved.

TABLE 1

| Constituent | Model 1% Change | Model 1 STD (%) | Model 2% Change | Model 2 STD (%) | Reference Ave. Delivery (%) | Reference STD (%) |
|---|---|---|---|---|---|---|
| 1,2-propadiene | −46 | 1 | −8 | 1 | 42.6 | 0.4 |
| 1,3-butadiene | −95 | 5 | −18 | 28 | 2.1 | 0.9 |
| Acetaldehyde | −100 | 0 | −27 | 9 | 4.0 | 0.8 |
| Acrolein | N/A | — | NA | — | 0 | 0 |
| carbon dioxide | −4 | 0.1 | 3 | 0 | 103.8 | 0.04 |
| Propene | −62 | 2 | −1 | 2 | 20.1 | 0.5 |
| Chloromethane | −52 | 2 | 2 | 3 | 18.2 | 0.4 |
| hydrogen cyanide | −84 | 4 | −9 | 3 | 5.6 | 0.8 |
| Ethane | −22 | 0.3 | 2 | 0 | 70.8 | 0.1 |
| Hydrogen sulfide | −52 | 2 | −25 | 6 | 6.4 | 0.7 |
| Carbonyl sulfide | −56 | 1 | −16 | 1 | 34.7 | 0.4 |

While the invention has been described in detail with reference to preferred embodiments thereof, it will be apparent to one skilled in the art that various changes can be made, and equivalents employed, without departing from the scope of the invention.

What is claimed is:

1. In a cigarette filter, comprising:

a mouth end;

a discrete sorbent section comprising activated carbon capable of removing constituents of mainstream smoke while displaying a lower selectivity for sulfur-containing constituents present therein;

at least one discrete flavoring section upstream of the mouth end, the improvement comprising a discrete section of sodium bicarbonate-treated fibers with sodium bicarbonate being provided on the fiber surface of said treated fibers by the application of a solution of dissolved sodium bicarbonate followed by drying whereby sodium bicarbonate is deposited to provide sodium bicarbonate in a concentration of from about 5 mg to about 100 mg of sodium bicarbonate located downstream of the discrete sorbent section comprising about 50 mg to about 250 mg activated carbon, upstream of the mouth end and upstream or downstream of the at least one discrete flavoring section, the treated fibers containing sodium bicarbonate as so deposited to counteract taste deficit associated with the activated carbon when tobacco smoke passes through the discrete sorbent section comprising activated carbon, whereby an alteration of constituents within mainstream smoke is facilitated upon smoking by the action of said sodium bicarbonate-treated fibers to remove hydrogen sulfide and carbonyl sulfide sulfur-containing constituents in the mainstream smoke.

2. The cigarette filter of claim 1, wherein the discrete section of sodium bicarbonate-treated fibers comprises cellulose tow, cellulose acetate tow, mono cellulose, mono acetate, propylene, polyester, polysulfone or polypropylene.

3. The cigarette filter of claim 1, wherein the filter contains in said discrete sorbent section comprising said activated carbon in the form of 0.3 mm to 0.5 mm diameter beads located in a cavity or fibers incorporated in a plug of fiber tow material.

4. The cigarette filter of claim 1, wherein the sodium bicarbonate-treated fibers contain about 5 mg to about 15 mg of sodium bicarbonate.

5. The cigarette filter of claim 1, wherein the discrete sorbent section comprising activated carbon contains activated carbon in the form of fibers having a length of from about 100 microns to about 1000 microns, and a diameter of from about 10 microns to about 25 microns, the activated carbon fibers intermingled with fiber tow material.

6. The cigarette filter of claim 5, wherein the discrete sorbent section comprising activated carbon is at least one disc shaped or cylindrical monolithic body.

7. The cigarette filter of claim 1, wherein the discrete section of sodium bicarbonate-treated fibers is located adjacent the discrete activated carbon section.

8. The cigarette filter of claim 1, wherein the discrete flavoring section is located downstream of the discrete section of sodium bicarbonate-treated fibers and upstream of the mouth end.

9. In a cigarette, comprising:

a tobacco column; and a cigarette filter attached to the tobacco column by tipping paper, the cigarette filter comprising:

a mouth end;

a discrete sorbent section comprising activated carbon capable of removing constituents from mainstream smoke while displaying a lower selectivity for sulfur-containing constituents present therein; and at least one discrete flavoring section upstream of the mouth end, the improvement comprising a discrete section of sodium bicarbonate-treated fibers with sodium bicarbonate being provided on the fiber surface of said treated fibers by the application of a solution of dissolved sodium bicarbonate followed by drying whereby sodium bicarbonate is deposited to provide sodium bicarbonate in a concentration of from about 5 mg to about 100 mg sodium bicarbonate located downstream of the discrete sorbent section comprising about 50 mg to about 250 mg activated carbon, upstream of the mouth end and upstream or downstream of the at least one discrete flavoring section, the treated fibers containing sodium bicarbonate as so deposited to counteract taste deficit associated with the activated carbon when tobacco smoke passes through the discrete sorbent section comprising activated carbon, whereby an alteration of constituents within mainstream smoke is facilitated upon smoking by the action of said sodium bicarbonate-treated fibers to remove hydrogen sulfide and carbonyl sulfide sulfur-containing constituents in the mainstream smoke.

10. The cigarette of claim 9, wherein the discrete section of sodium bicarbonate-treated fibers comprises cellulose tow, cellulose acetate tow, mono cellulose, mono acetate, propylene, polyester, polysulfone or polypropylene.

11. The cigarette of claim 9, wherein the discrete sorbent section comprising activated carbon is in the form of fibers having a length of from about 100 microns to about 1000 microns, and a diameter of from about 10 microns to about 25 microns, the activated carbon fibers intermingled with fiber tow material.

12. The cigarette of claim 9, wherein the discrete sorbent section comprising activated carbon is at least one disc shaped or cylindrical monolithic body or the discrete section of sodium bicarbonate-treated fibers is located upstream of and adjacent the discrete section of sodium bicarbonate-treated fibers.

13. The cigarette of claim 9, wherein the at least one discrete flavoring section is located downstream of the discrete section of sodium bicarbonate-treated fibers and upstream of the mouth end of the filter.

14. A method of manufacturing a cigarette, comprising:

placing a paper wrapper around a tobacco column; and attaching the cigarette filter of claim 1 to the tobacco column to form the cigarette.

15. In a method of treating mainstream smoke comprising removing smoke constituents by contacting mainstream smoke with a discrete sorbent section comprising activated carbon capable of removing constituents of mainstream smoke while displaying a lower selectivity for sulfur-containing constituents present therein, the improvement comprising subsequently contacting the mainstream smoke with a discrete section of sodium bicarbonate treated fibers with sodium bicarbonate being provided on the fiber surface of said treated fibers by the application of a solution of dissolved sodium bicarbonate followed by drying whereby sodium bicarbonate is deposited to provide sodium bicarbonate in a concentration of from about 5 to about 100 mg of sodium bicarbonate located downstream of the discrete sorbent section comprising about 50 mg to about 250 mg activated carbon and contacting the mainstream smoke with a discrete flavoring section located downstream of the discrete section of sodium bicarbonate, the treated fibers containing sodium bicarbonate as so deposited to counteract taste deficit associated with the activated carbon when tobacco smoke passes through the discrete sorbent section comprising activated carbon, and then passing the mainstream smoke through at least one discrete flavoring section, whereby an alteration of constituents within mainstream smoke is facilitated upon smoking by the action of said sodium bicarbonate-treated fibers to remove hydrogen sulfide and carbonyl sulfide sulfur-containing constituents in the mainstream smoke.

16. The method of claim 15, comprising releasing a flavor from the discrete flavoring section into the mainstream smoke.

17. The method of claim 16, wherein the flavor is menthol.

18. In a smoking article comprising:

tobacco;

a discrete sorbent section comprising activated carbon; and at least one discrete flavoring section, the improvement comprising a discrete section of sodium bicarbonate-treated fibers with sodium bicarbonate being provided on the fiber surface of said treated fibers by the application of a solution of dissolved sodium bicarbonate followed by drying whereby sodium bicarbonate is dissolved to provide sodium bicarbonate area in a concentration of from about 5 mg to about 100 mg of sodium bicarbonate arranged such that mainstream smoke produced by the tobacco contacts the discrete sorbent section comprising about 50 mg to about 250 mg activated carbon capable of removing constituents of mainstream smoke while displaying a lower selectivity for sulfur-constituents therein before contacting the discrete section of sodium bicarbonate-treated fibers, the treated fibers containing sodium bicarbonate as so deposited to counteract taste deficit associated with the activated carbon when tobacco smoke passes through the discrete activated carbon section, wherein the discrete section of sodium-bicarbonate treated fibers is located downstream of the discrete sorbent section comprising activated carbon and upstream or downstream of the at least one discrete flavoring section, whereby an alteration of constituents within mainstream smoke is facilitated upon smoking by the action of said sodium bicarbonate-treated fibers to remove hydrogen sulfide and carbonyl sulfide sulfur-containing constituents in the mainstream smoke.

19. The smoking article of claim 18, wherein the at least one discrete flavoring section is located entirely downstream of the discrete section of sodium-bicarbonate treated fibers and the discrete sorbent section comprising activated carbon.

20. The cigarette of claim 9, wherein the sodium bicarbonate-treated fibers contain about 5 mg to about 15 mg of sodium bicarbonate.

21. The method of claim 15, wherein the sodium bicarbonate-treated fibers contain about 5 mg to about 15 mg of sodium bicarbonate.

22. The smoking article of claim 18, wherein the sodium bicarbonate-treated fibers contain about 5 mg to about 15 mg of sodium bicarbonate.

23. The method of claim 15, wherein the discrete section of sodium bicarbonate-treated fibers comprises cellulose tow, cellulose acetate tow, mono cellulose, mono acetate, propylene, polyester, polysulfone or polypropylene.

24. The smoking article of claim 18, wherein the discrete section of sodium bicarbonate-treated fibers comprises cellulose tow, cellulose acetate tow, mono cellulose, mono acetate, propylene, polyester, polysulfone or polypropylene.

25. In a cigarette filter, comprising:

a mouth end;

a discrete sorbent section comprising activated carbon capable of removing constituents of mainstream smoke while displaying a lower selectivity for sulfur-containing constituents present therein;

at least one discrete flavoring section upstream of the mouth end, the improvement comprising a discrete section of sodium bicarbonate-treated fibers comprising cellulose tow, cellulose acetate tow, mono cellulose, mono acetate, propylene, polyester, polysulfone or polypropylene with sodium bicarbonate being provided on the fiber surface of said treated fibers by the application of an aqueous solution of dissolved sodium bicarbonate followed by drying whereby sodium bicarbonate is deposited to provide sodium bicarbonate having an enhanced surface area in a concentration of from about 5 mg to about 100 mg of sodium bicarbonate located downstream of the discrete sorbent section comprising about 50 mg to about 250 mg activated carbon, upstream of the mouth end and upstream of the at least one discrete flavoring section, the treated fibers containing sodium bicarbonate as so deposited to counteract taste deficit associated with the activated carbon when tobacco smoke passes through the discrete sorbent section comprising activated carbon, whereby an alteration of constituents within mainstream smoke is facilitated upon smoking by the action of said sodium bicarbonate-treated fibers to remove hydrogen sulfide and carbonyl sulfide sulfur-containing constituents in the mainstream smoke.

26. In a cigarette, comprising:

a tobacco column; and a cigarette filter attached to the tobacco column by tipping paper, the cigarette filter comprising:

a mouth end;

a discrete sorbent section comprising activated carbon capable of removing constituents from mainstream smoke while displaying a lower selectivity for sulfur-containing constituents present therein; and at least one discrete flavoring section upstream of the mouth end, the improvement comprising a discrete section of sodium bicarbonate-treated fibers comprising cellulose tow, cellulose acetate tow, mono cellulose, mono acetate, polyester, polysulfone or polypropylene with sodium bicarbonate being provided on the fiber surface of said treated fibers by the application of an aqueous solution of dissolved sodium bicarbonate followed by drying whereby sodium bicarbonate is deposited to provide sodium bicarbonate having an enhanced surface area in a concentration of from about 5 mg to about 100 mg sodium bicarbonate located downstream of the discrete sorbent section comprising about 50 mg to about 250 mg activated carbon, upstream of the mouth end and upstream of the at least one discrete flavoring section, the treated fibers containing sodium bicarbonate as so deposited to counteract taste deficit associated with the activated carbon when tobacco smoke passes through the discrete sorbent section comprising activated carbon, whereby an alteration of constituents within mainstream smoke is facilitated upon smoking by the action of said sodium bicarbonate-treated fibers to remove hydrogen sulfide and carbonyl sulfide sulfur-containing constituents in the mainstream smoke.

27. In a method of treating mainstream smoke comprising removing smoke constituents by contacting mainstream smoke with a discrete sorbent section comprising activated carbon capable of removing constituents of mainstream smoke while displaying a lower selectivity for sulfur-containing constituents present therein, the improvement comprising subsequently contacting the mainstream smoke with a discrete section of sodium bicarbonate treated fibers comprising cellulose tow, cellulose acetate tow, mono cellulose, mono acetate, polyester, polysulfone or polypropylene with sodium bicarbonate being provided on the fiber surface of said treated fibers by the application of an aqueous solution of dissolved sodium bicarbonate followed by drying whereby sodium bicarbonate is deposited to provide sodium bicarbonate having an enhanced surface area in a concentration of from about 5 to about 100 mg of sodium bicarbonate located downstream of the discrete sorbent section comprising about 50 mg to about 250 mg activated carbon and contacting the mainstream smoke with a discrete flavoring section located downstream of the discrete section of sodium bicarbonate, the treated fibers containing sodium bicarbonate as so deposited to counteract taste deficit associated with the activated carbon when tobacco smoke passes through the discrete sorbent section comprising activated carbon, and then passing the mainstream smoke through at least one discrete flavoring section, whereby an alteration of constituents within mainstream smoke is facilitated upon smoking by the action of said sodium bicarbonate-treated fibers to remove hydrogen sulfide and carbonyl sulfide sulfur-containing constituents in the mainstream smoke.

28. In a smoking article comprising:

tobacco;

a discrete sorbent section comprising activated carbon; and at least one discrete flavoring section, the improvement comprising a discrete section of sodium bicarbonate-treated fibers comprising cellulose tow, cellulose acetate tow, mono cellulose, mono acetate, polyester, polysulfone or polypropylene with sodium bicarbonate being provided on the fiber surface of said treated fibers by the application of a solution of dissolved sodium bicarbonate followed by drying whereby sodium bicarbonate is deposited to provide sodium bicarbonate having an enhanced surface area in a concentration of from about 5 mg to about 100 mg of sodium bicarbonate arranged such that mainstream smoke produced by the tobacco contacts the discrete sorbent section comprising about 50 mg to about 250 mg activated carbon capable of removing constituents of mainstream smoke while displaying a lower selectivity for sulfur-constituents therein before contacting the discrete section of sodium bicarbonate-treated fibers, the treated fibers containing sodium bicarbonate as so deposited to counteract taste deficit associated with the activated carbon when tobacco smoke passes through the discrete activated carbon section, wherein the discrete section of sodium-bicarbonate treated fibers is located downstream of the discrete sorbent section comprising activated carbon and upstream of the at least one discrete flavoring section, whereby an alteration of constituents within mainstream smoke is facilitated upon smoking by the action of said sodium bicarbonate-treated fibers to remove hydrogen sulfide and carbonyl sulfide sulfur-containing constituents in the mainstream smoke.

* * * * *